US005879421A

United States Patent [19]

Liu et al.

[11] Patent Number: 5,879,421

[45] Date of Patent: Mar. 9, 1999

[54] APPARATUS AND METHOD FOR FORMING AN AGGREGATE PRODUCT FROM PARTICULATE MATERIAL

[75] Inventors: Henry Liu; Yuyi Lin, both of Columbia, Mo.; Yu Lin, Jiangzi, China

[73] Assignee: The Curators of the University of Missouri, Columbia, Mo.

[21] Appl. No.: 950,354

[22] Filed: Oct. 14, 1997

[51] Int. Cl.[6] ..... C10L 5/06; C10L 5/36

[52] U.S. Cl. ..... 44/535; 44/593; 44/596; 44/634; 44/635; 44/636; 249/82

[58] Field of Search ..... 44/535, 634, 635, 44/636, 596, 593; 249/82

[56] References Cited

U.S. PATENT DOCUMENTS

| | | | |
|---|---|---|---|
| 4,015,731 | 4/1977 | Verschuur | 406/197 |
| 4,183,731 | 1/1980 | Eisel | 44/593 |
| 4,243,393 | 1/1981 | Christian | 44/519 |
| 4,389,218 | 6/1983 | Pike | 44/530 |
| 4,494,962 | 1/1985 | Christie et al. | 44/535 |
| 4,606,876 | 8/1986 | Yoshida et al. | 264/120 |
| 5,067,968 | 11/1991 | Davidson et al. | 44/550 |
| 5,658,357 | 8/1997 | Liu et al. | 44/550 |

OTHER PUBLICATIONS

Brent Gunnink and Zhuoxiong Liang, Proceedings of the 17th International Conference on Coal Utilization and Slurry Technologies, "Compaction of Binderless Coal Logs For Coal Pipelines", 1992, pp. 677–686.

M.R. Miller, G.L. Fields, R. W. Fisher and T.D. Wheelock, Proceedings of the 16th Biennial Conference, IBA, "Coal Briquetting Without A Binder", pp. 325–319 Date Unknown.

Brett Gunnink and Zhuoxiong Liang, Journal of Fuel Processing Technology, "Compaction of Binderless Coal For Coal Log Pipelines", 1994, vol. 37, pp. 237–254 Date Unknown.

Henry Liu, et al., 19th International Technical Conference On Coal Utilization And Fuel Systems, "Coal Log Technology for Handling And Transporting Coal Fines", Mar. 1994, pp. 1–5.

Jayanth J. Kananur, Masters of Science Thesis, University of Missouri–Columbia, "Compaction of High Strength Binderless Coal Logs For Pipeline Transportation", Aug. 1994, pp. 1–106.

Zhuoxiong Liang, Masters of Science Thesis, University of Missour–Columbia, "Compaction of Binderless Coal For Coal Log Pipelines", May 1993, pp. 1–132.

M.V. Chari, Bechtel Group, Inc., "Thermal Upgrading Of Low–Rank Coal A Process–Screening Study", Research Project 2221–11, Final Report, Mar. 1986, pp. 1–4, A1–A3, B1–B3, C1–C3, D1–D3 and R1–R2.

R.J. Piersol, State of Illinois Department of Registration and Education, Division of the State Geological Survey. "Briquetting Illinois Coals Without a Binder by Compression and by Impact—A Progress Report of a Laboratory Investigation", 1933, pp. 4–70 month unknown.

(List continued on next page.)

*Primary Examiner*—Ellen M. McAvoy
*Attorney, Agent, or Firm*—Senniger, Powers, Leavitt & Roedel

[57] ABSTRACT

This invention is directed to a method and apparatus for forming an aggregate product from particulate material, and in particular for making an aggregate coal product from coal particles. The method involves the steps of 1) loading the coal particles into a mold having an open end and an inner surface defining, in part, a pressurization chamber, the open end of the mold having an outwardly flaring inner peripheral end surface, 2) pressurizing the coal particles within the pressurization chamber such that the coal particles aggregate to form the coal log, and 3) pushing the coal log out of the mold past the flared end surface so that the coal log expands as it passes the end surface. The method may also include the step of maintaining back pressure on the coal log as it is pushed out of the mold. In addition to coal logs, the mold configuration of this invention may be used for making other aggregate products from particulate materials.

29 Claims, 6 Drawing Sheets

OTHER PUBLICATIONS

H.R. Gregory, Journal of the Institute of Fuel, "A New Process for Briquetting Coal Without a Binder" Sep. 1960, pp. 447–461.

D.C. Rhys Jones, Chemistry of Coal Utilization: Supplementary Volume, Chapter 16, "Briquetting", pp. 675–753 month unknown.

G. Ellison and B.R. Stanmore, Journal of Fuel Processing Technology, "High Strength Binderless Brown Coal Briquettes" 1981, vol.4, pp. 277–289 and 291–304.

D. Makrutzki, et al., Aufbereitungs–Technik, "Continuous Briquetting Of Hard Coal Without A Binder", 1989, No. 7, pp. 405–412.

APPARATUS AND METHOD FOR FORMING AN AGGREGATE PRODUCT FROM PARTICULATE MATERIAL

The U.S. Government has rights in this invention pursuant to Contract No. EEC-9108841 awarded by the National Science Foundation.

BACKGROUND OF THE INVENTION

This invention relates generally to apparatus and methods for making aggregate product from particulate material, and more particularly to apparatus and methods for making an aggregate coal product by compacting or extruding coal particles.

Coal is widely used as a fuel source for generating heat and is often transported over long distances from the mining area to the end user. In order that coal remain an attractive fuel source, it is imperative that means be devised to transport coal efficiently and economically.

Coal fines, which are extremely small coal particles typically having a diameter of about 1 mm or less, are produced in significant quantities by the washing of mined coal and possess a potentially significant heating value. However, their large water content often makes them difficult to handle and use as a fuel source. Currently, because coal fines cannot be dewatered and/or processed into a form which may be easily transported economically, they are usually collected in tailing ponds as a waste product of coal mining or coal preparation operations rather than being recovered. Coal fines represent a significant environmental problem which would be reduced if a process were available which could economically convert coal fines into a usable fuel source.

It has been suggested that mined coal particles, coal fines and other carboniferous particles could be processed into a more easily transportable and usable form by fabricating aggregate products from the particulate material. It is generally known that loose particles of coal can be formed into aggregate products (e.g., various shaped briquettes) by compacting or extruding a mixture of coal particles and a significant amount of a binder additive (e.g., pitch).

In particular, it is contemplated that cylindrical aggregates of coal, otherwise referred to as coal logs, can be easily transported through a hydraulic coal log pipeline, such as that described and shown in U.S. Pat. No. 4,946,317 (Liu et al.). To withstand the rigors of transporting coal logs through the pipeline, the coal logs must be dense and have a high tensile strength to inhibit the coal logs from fragmenting during transport.

Conventional production of coal logs generally involves feeding coal particles mixed with a binder additive into a cylindrical mold and compacting or extruding the coal particles to form a coal log. The end surface of the mold is typically flat, presenting a sharp corner at the mold exit. As the coal log is ejected from the mold, elastic recovery of the coal log causes it to expand rapidly against the sharp corner of the mold exit, creating a high stress concentration in the coal log. A major problem associated with this type of production is the causation of deep circumferential cracks, or even splitting of the coal log into pieces (disks), due to the high stress concentration caused by the sharp cornered mold exit.

Tapered molds are sometimes used in industry to form aggregate products from particulate material. In this type of mold, the inner surface of the mold is tapered from one end of the mold to the other to allow the aggregate product to expand as it exits the mold. However, compacting or extruding particulate material in a mold having a fully tapered inner surface inhibits complete compaction of the particulate material, resulting in aggregate products which are of a lesser quality than products formed in a mold having a straight inner surface. Additionally, a fully tapered mold is impractical for use in forming coal logs because the product formed by the mold is generally conical, and would not travel properly through the coal log pipeline.

There is a need, therefore, for an improved method and apparatus for forming an aggregate product from particulate material, particularly in making coal logs from coal particles. This invention is directed to such a method and apparatus.

Among the several objects and features of the present invention are the provision of an improved mold, apparatus and method for making a stronger, higher quality aggregate product from particulate material; the provision of such a mold, apparatus and method which will produce coal logs having sufficient strength and durability to withstand the rigors of handling and transport; the provision of such an apparatus which recovers water released from the coal within the mold during pressurization; and the provision of such a mold, apparatus and method in which the time required to produce a coal log of increased quality is significantly reduced.

In general, this invention involves a mold for use in making an aggregate product from particulate material. The mold has open ends and an inner surface between the open ends defining, in part, a pressurization chamber for receiving the particulate material so that it may be pressurized to form the aggregate product. The pressurization chamber has a central longitudinal axis, wherein the inner surface of the mold is substantially parallel to the central longitudinal axis. One of the open ends of the mold has a flared inner peripheral end surface flaring outwardly away from the pressurization chamber and the central longitudinal axis for allowing expansion of the aggregate product as it is pushed out of the one end of the mold past the flared end surface.

In another aspect, an apparatus for making a coal log from coal particles comprises a frame, a mold supported by the frame having open first and second ends as set forth above, and pressurizing means supported by the frame operable to pressurize the coal particles within the pressurization chamber to form the coal log and to push the coal log out of the first end of the mold past the flared end surface.

In yet another aspect, a method for making a coal log from coal particles comprises loading the coal particles into a mold having an open end and an inner surface defining, in part, a pressurization chamber. The open end has a flared inner peripheral end surface. The coal particles are pressurized within the pressurization chamber such that the coal particles aggregate to form the coal log. The coal log is pushed out of the mold past the flared end surface so that the coal log expands as it passes the flared end surface.

Another aspect of the method of making coal logs from coal particles comprises loading the coal particles into a mold having first and second open ends and an inner surface defining, in part, a pressurization chamber. First and second rams are operated to apply compacting pressures to the coal particles in the pressurization chamber to form the coal log. After the coal log is formed, the compacting pressure applied by the first ram is reduced and the second ram continues to apply a force sufficient to push the coal log out of the mold while the first ram maintains a back pressure on the coal log as it is pushed out of the mold.

Other objects and features will become in part apparent and in part pointed out hereinafter.

BRIEF DESCRIPTION OF THE DRAWINGS

Corresponding parts are designated by corresponding numerals throughout the several views of the drawings.

DESCRIPTION OF THE PREFERRED EMBODIMENT

Figure 1:
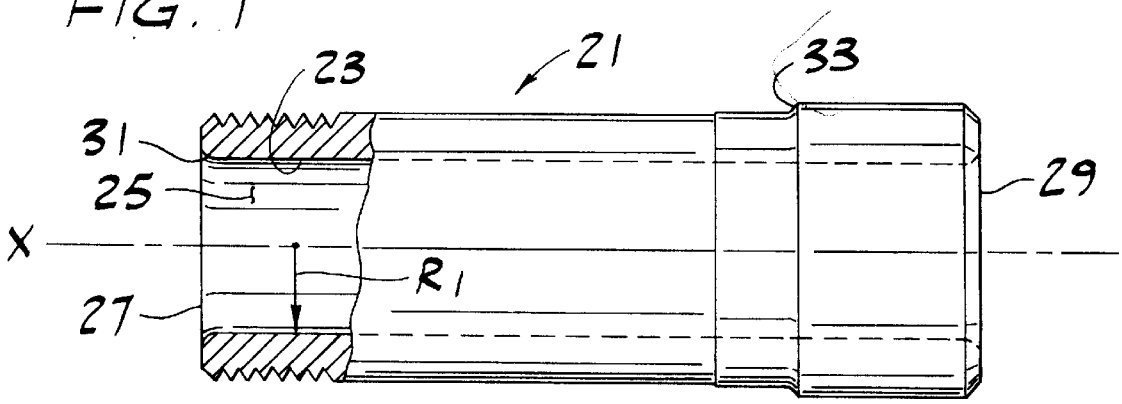
FIG. 1 is a side elevation of a mold of the present invention with a portion broken away to show a rounded end surface of the mold.

Referring first to FIG. 1, a mold of the present invention for use in forming an aggregate product from particulate material is indicated in its entirety by the reference numeral 21. The mold is preferably constructed of a high strength metal, such as stainless steel or other suitable material having similar properties. As shown in FIG. 1, the mold is generally cylindrical in overall shape and has an inner cylindrical surface 23 which partially defines a pressurization chamber 25 for receiving and holding particulate material to be pressurized into the aggregate product. This cylindric surface 23 has a predetermined radius R1 and extends generally parallel to the central longitudinal axis X of the pressurization chamber 25. It is understood, however, that the exterior of the mold 21, as well as the inner surface 23 of the mold, may be of any shape without departing from the scope of this invention, as long as the inner surface defining, in part, the pressurization chamber 25 is parallel to the central longitudinal axis X of the mold. The mold 21 has open ends 27, 29 to provide access to the pressurization chamber 25 for loading the particulate material into the pressurization chamber and for ejecting the finished product.

The mold 21 has a flared inner peripheral end surface 31 at one end 27, flaring outward away from the central longitudinal axis X and the inner surface 23 of the mold, thereby providing an increasing diameter at one end of the mold. Due to its elastic nature, the aggregate product expands in conformance with the outwardly flared end surface 31 as it exits the mold 21 past this surface. Providing the flared end surface 31 thus allows a gradual expansion of the aggregate product, thereby reducing the stress concentration on the product and hence reducing the risk of cracking or splitting.

Figure 2:
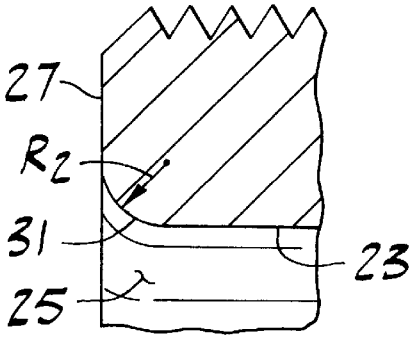
FIG. 2 is an enlarged horizontal section of the rounded end surface of the mold of FIG. 1.
Figure 3:
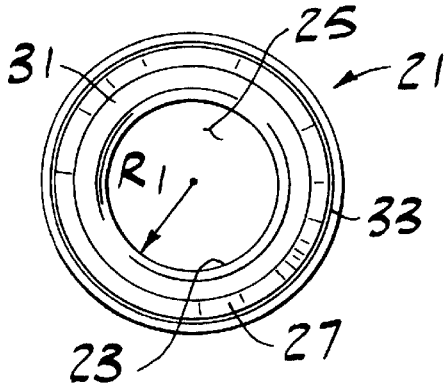
FIG. 3 is a left end view of the mold of FIG. 1.

As illustrated in FIGS. 1 and 2, the flared end surface 31 of the preferred mold is rounded. The rounded end surface 31 has a radius of curvature R2 which may vary with respect to the radius R1 of the inner surface 23 of the mold 21 and with respect to the type of particulate material being pressurized. The mold 21 shown in FIG. 1 is particularly useful in making coal logs from coal particles. Through experimental testing, it has been determined that the optimum radius of curvature R2 of the rounded end surface 31 for making coal logs is approximately 13 percent of the radius R1 of the inner surface 23 of the mold 21. For example, experimental manufacture of coal logs using a mold having a radius R1 of approximately 22.25 mm and a radius of curvature R2 of 3.18 mm yielded satisfactory results. The overall length of the mold ranged from 9 to 12 inches, yielding coal logs of approximately 2.5 inches in length. The mold shown in FIG. 1 is 24 inches in length and has a radius R1 of the inner surface 23 of approximately 2.7 inches. Thus, the radius of curvature R2 is preferably approximately 0.32 inches. However, it is contemplated that the radius R1 of the inner surface 23, as well as the radius of curvature R2 of the rounded end surface 31 and the length of the mold, may vary substantially and remain within the scope of this invention.

Figure 4:
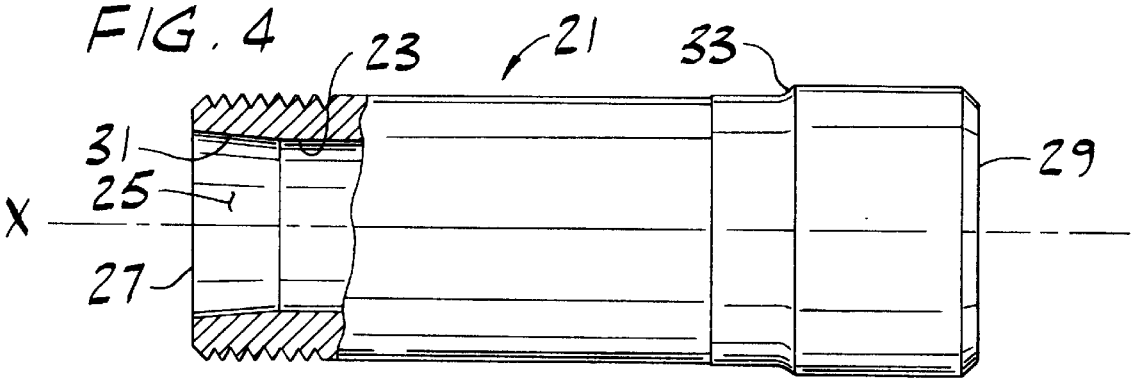
FIG. 4 is a side elevation of a mold of the present invention with a portion broken away to show a tapered end surface of the mold.
Figure 5:
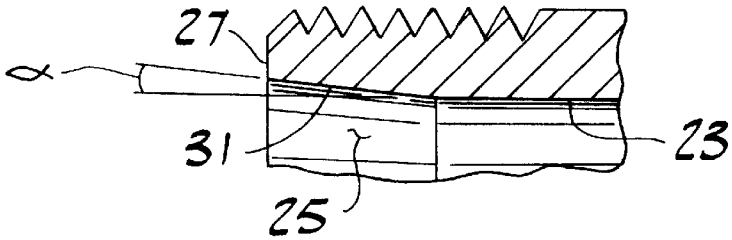
FIG. 5 is an enlarged horizontal section of the tapered end surface of the mold of FIG. 4.

As shown in FIGS. 4 and 5, the flared end surface 31 may also be tapered rather than rounded. The aggregate product formed within the pressurization chamber 25 gradually expands in conformance with the slope of the taper as it exits the mold 21 past the tapered end surface 31. The taper angle $\alpha$ is generally small. For example, experimental manufacture of coal logs using a mold having a taper angle $\alpha$ of approximately one degree and a taper length of 2.29 inches, compared to an overall length of the mold in the range of approximately 9 to 12 inches, yielded satisfactory results. However, it is contemplated that the taper angle $\alpha$, taper length and overall mold length may vary substantially and remain within the scope of this invention.

It is understood that the mold 21 of the present invention may be used for various applications other than coal log production in which elastic recovery of the aggregate product takes place upon ejection from the mold, such as, for example, in the compaction or extrusion of ceramics, plastics and medicine tablets.

Figure 6:
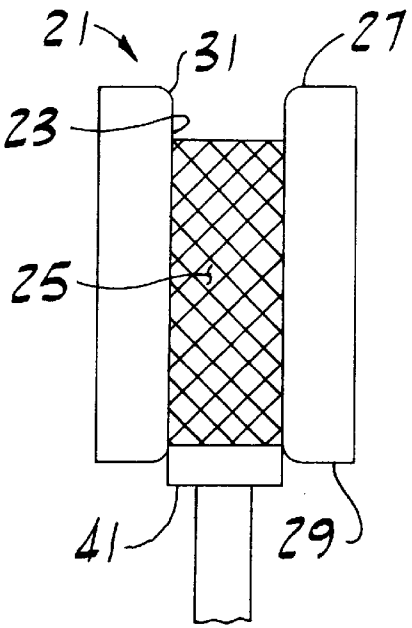

The method of this invention for making coal logs is demonstrated in FIGS. 6–9. In FIG. 6, the mold 21 of FIG. 1 having a rounded end surface 31 is shown in an upright position in which the end 27 of the mold having the rounded end surface 31 defines an upper end of the mold and the opposing end 29 defines a lower end of the mold. A lower ram 41 is shown extending upward into the lower end 29 of the mold 21 to seal the lower end. The coal particles are loaded into the mold 21 through the open upper end 27 of the mold along with a binder additive, such as pitch.

Figure 7:
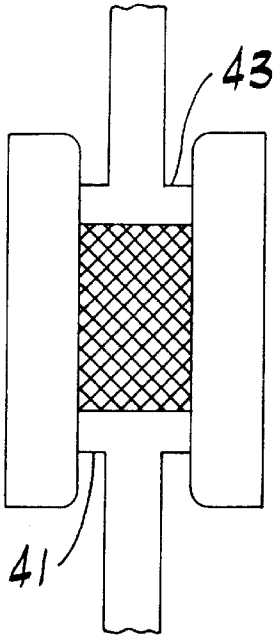

As shown in FIG. 7, an upper ram 43 is operable to move down into the upper end 27 of the mold 21 such that the inner surface 23 of the mold and the opposing rams 41, 43 together define the pressurization chamber 25 for containing the coal particles to be pressurized. The rams 41, 43 are then urged toward one another to pressurize the coal particles within the chamber 25. For example, a pressure of 20,000 psi is preferably applied by each ram 41, 43 to the coal particles. However, the pressure may vary depending on the type of coal or other material being pressurized. By applying sufficient pressure, the particles will aggregate to form a coal log. A heater (not shown), such as a resistive heater, may be mounted around the mold 21 for heating the mold, thereby heating the coal within the pressurization chamber 25 during pressurization to produce better quality coal logs. Alternatively, the mold may be at room temperature and the coal particles may be pre-heated before being loaded into the mold. However, heating is not required and both the coal particles and the mold may be maintained at room temperature without departing from the scope of this invention.

Figure 8:
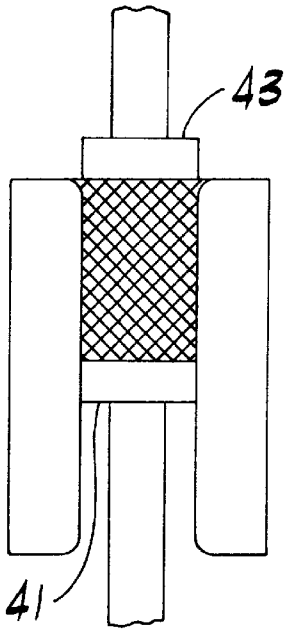

After the coal log is formed, the pressures applied to the coal log by the rams 41, 43 are reduced to initiate ejection of the coal log from the mold 21. The pressure applied to the coal log by the upper ram 43 is then further reduced to a pressure less than the pressure applied by the lower ram 41 so that the lower ram is operable to push the coal log up out of the mold 21 toward the rounded end surface 31 (FIG. 8). During ejection of the coal log, the upper ram 43 maintains pressure contact with the coal to apply a back pressure against the coal log. Applying a back pressure maintains compression of the coal particles as the coal log is being pushed out of the mold 21. In making coal logs, the preferred back pressure applied by the upper ram 43 is approximately eight percent of the maximum pressure applied by the upper ram to pressurize the coal particles. For example, for a 20,000 psi maximum pressure, the back pressure applied to the coal log by the upper ram 43 during ejection of the log from the mold 21 is preferably about 1,600 psi. However, this preferred back pressure may vary substantially depending on the various properties of the coal or other material being pressurized.

Figure 9:
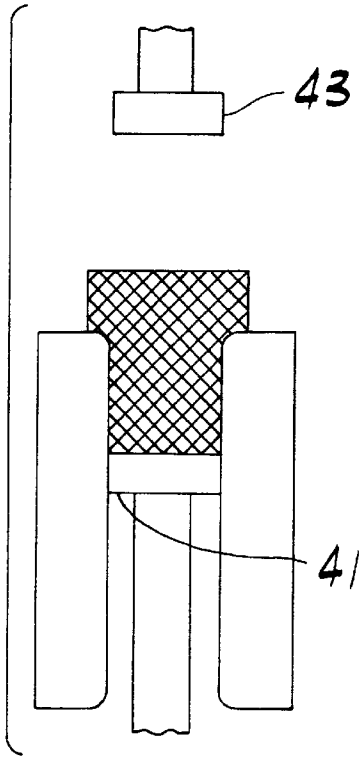
FIGS. 6–9 are schematic views illustrating sequential steps in the method of the present invention for making a coal log.

As the leading edge of the coal log reaches the rounded (or tapered) end surface 31 of the mold 21, the coal log expands in conformance with the curvature (or slope) of the end surface. The upper ram 43 is preferably withdrawn from contacting the coal log once the leading edge of the coal log passes beyond the end 27 of the mold, thereby removing the back pressure applied to the coal log. This reduces the risk of damage to the coal log as the coal log expands outside the mold. As shown in FIG. 9, once the upper ram 43 is withdrawn, the pressure applied by the lower ram 41 pushes the coal log out of the mold 21 without substantial resistance (the only resistance being friction between the coal log and the inner surface 23 of the mold).

While pressurization of the coal particles is preferably created by compaction, such as by the upper and lower rams 41, 43, pressurization may be created by other suitable means, such as by extrusion of the coal particles, and remain within the scope of this invention. Additionally, in applying the compaction pressure as shown in FIGS. 6–9, the lower ram 41 may remain fixed while only the upper ram moves to compact the coal particles. Moreover, the mold 21 may be oriented horizontally, or oriented vertically with the rounded end surface 31 facing downward, and remain within the scope of this invention.

It is also understood that the method of the present invention is not limited to producing coal logs from coal particles. This method may be used to form aggregate products from other particulate materials that are commonly compacted or extruded, such as ceramics, biomass, plastics and medicine tablets, without departing from the scope of this invention.

Figure 10:
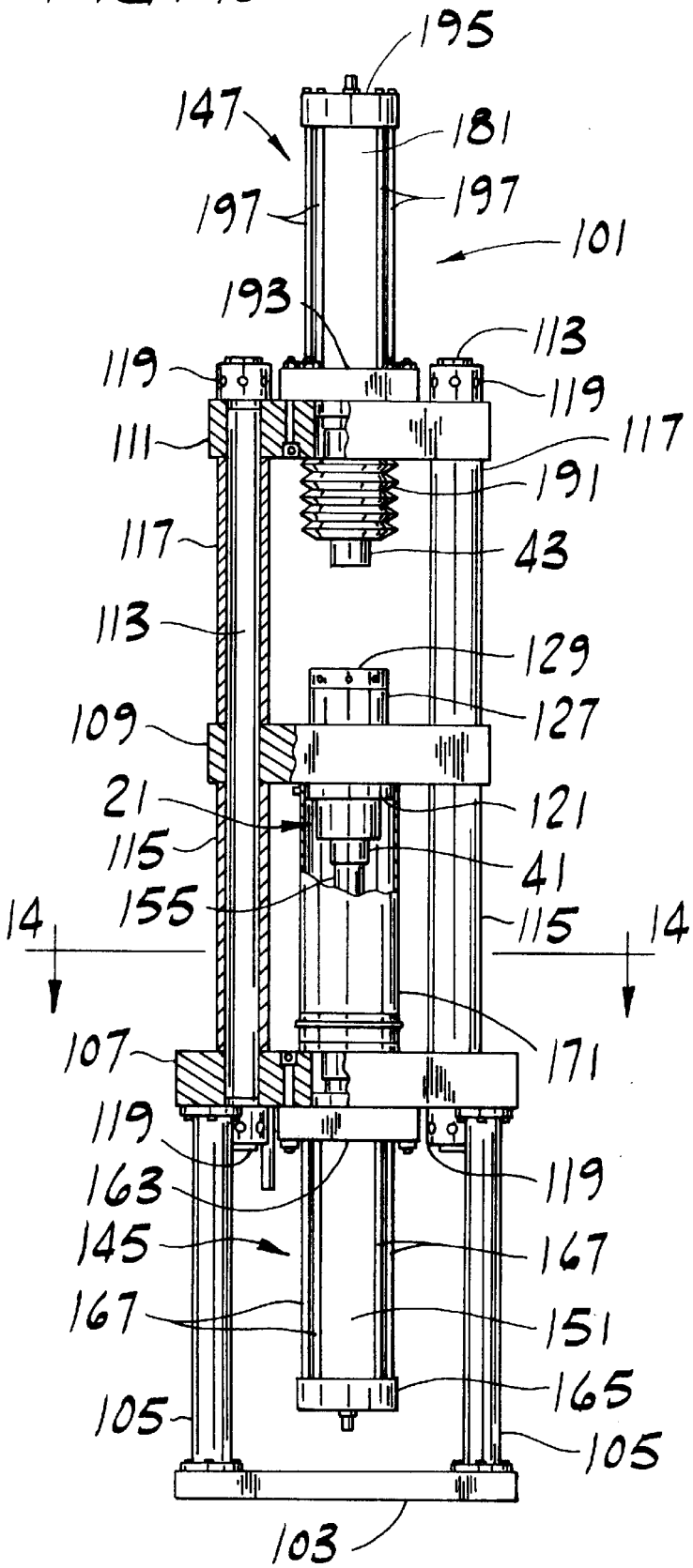
FIG. 10 is a side elevation of an apparatus of the present invention with parts cut away to reveal internal structure.
Figure 11:
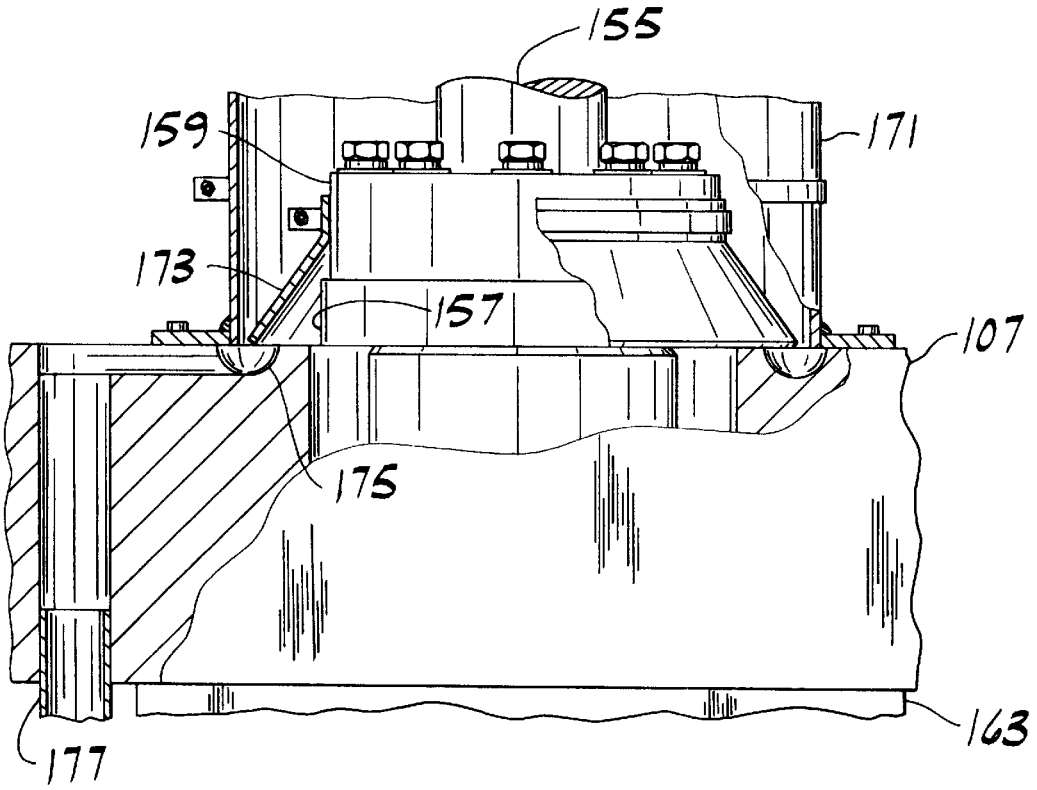
FIG. 11 is an enlarged side elevation of a portion of the apparatus of FIG. 10 with parts cut away to reveal internal structure.
Figure 12:
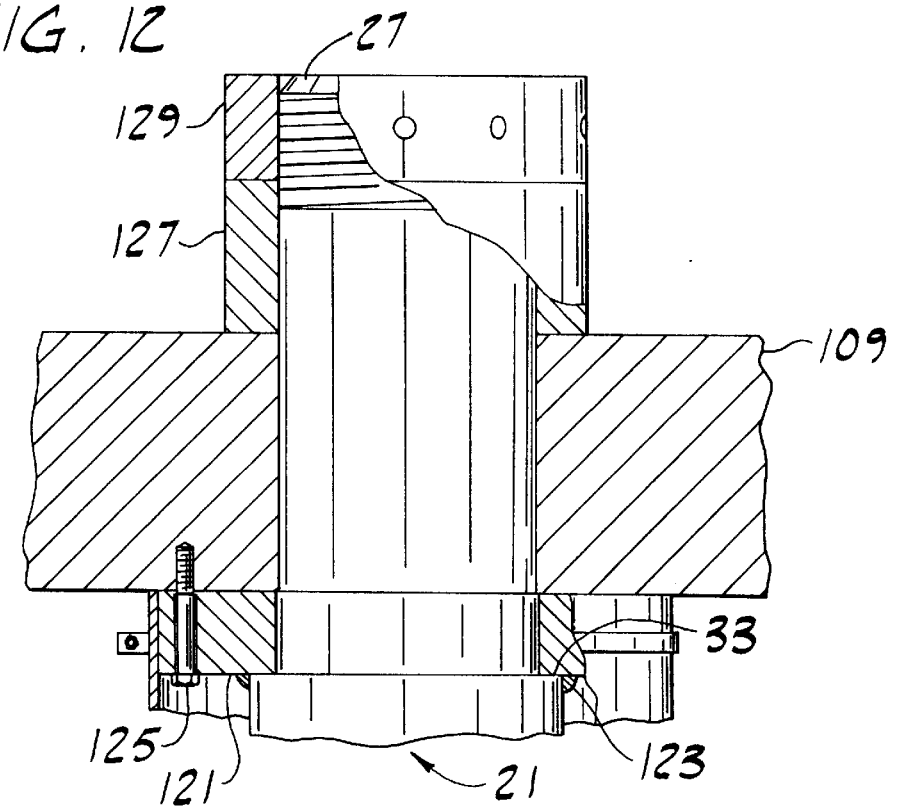
FIG. 12 is an enlarged side elevation of another portion of the apparatus of FIG. 10 with parts cut away to reveal internal structure.

Referring now to FIG. 10, apparatus of the present invention for forming a coal log from coal particles is shown as comprising a compaction machine, designated in its entirety by the reference numeral 101. The compaction machine 101 comprises a rectangular base 103, four vertical supports 105 (two of which are shown in FIG. 10) extending up from the base generally at the corners of the base, and a lower horizontal plate 107 secured to the upper ends of the supports. The machine also includes a center horizontal plate 109 spaced above the lower plate 107, an upper horizontal plate 111 spaced above the center plate 109, and four vertical posts 113 extending through clearance holes in the plates and connecting the three plates. Eight spacer sleeves are mounted on the posts for maintaining the appropriate spacing between the plates. In the embodiment shown, four sleeves 115 are mounted on the posts 113 between the lower plate 107 and the center plate 109, and another four sleeves 117 (two of which are shown in FIG. 10) are mounted on the posts between the center plate 109 and the upper plate 111. The three plates 107, 109, 111 and posts 113 are held in assembly by nuts 119 threaded on the upper and lower ends of the posts. The posts 113, plates 107, 109, 111 and sleeves 115, 117 together define a frame for supporting the operating components of the machine.

Figure 13:
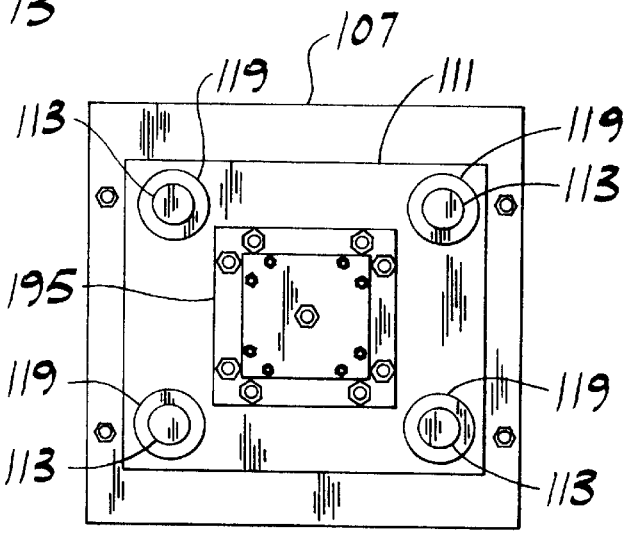
FIG. 13 is a top view of the apparatus of FIG. 10.
Figure 14:
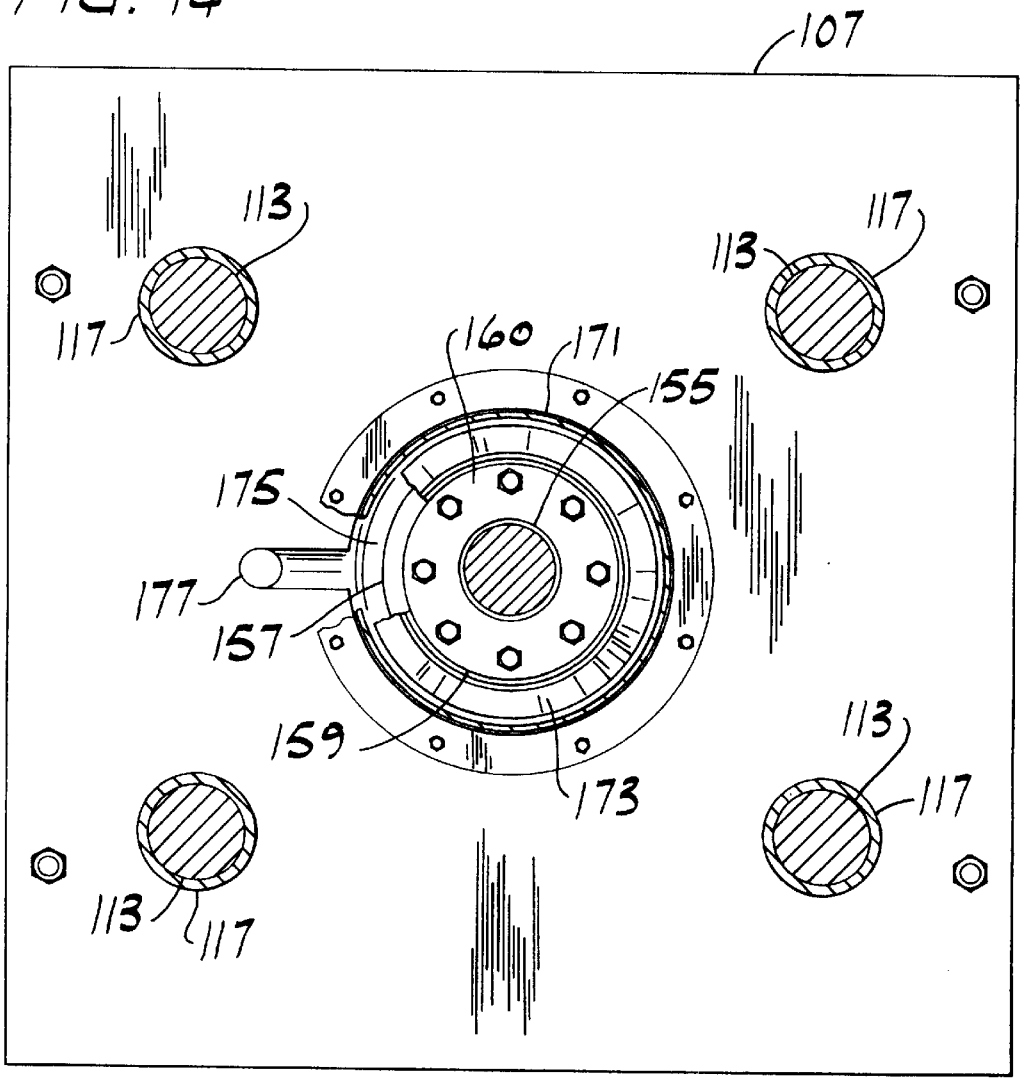
FIG. 14 is an enlarged horizontal section taken along line 14—14 of FIG. 10.

The mold 21 shown in FIG. 1 is particularly useful in the compaction machine 101 of FIG. 10. The mold 21 is oriented vertically in the compaction machine so that the rounded end surface 31 is at the upper end 27 of the mold. The exterior of the mold 21 is threaded adjacent the upper end 27 (see FIG. 1) and is enlarged adjacent its lower end 29 to provide an annular shoulder 33 between the enlarged section and the remainder of the mold exterior. For example, the mold shown in FIG. 1 has a diameter of approximately 8.125 inches at its upper end 27 and a diameter of approximately 9.0 inches at the enlarged lower end 29. A mounting ring 121 (FIG. 13) seats against this shoulder 33 and is secured to the mold 21 as by welding 123 or other suitable fasteners. The mold 21 extends up through a central opening in the center plate 109 of the machine 101 such that the mounting ring 121 abuts the center plate and the upper end 27 of the mold extends above the center plate. Fastening screws 125 secure the mounting ring 121 and mold 21 to the center plate 109. A spacer 127 is disposed around the portion of the mold 21 extending above the center plate 109, and a mold nut 129 is threaded on the threaded upper end 27 of the mold tight against the spacer to stably secure the mold on the center plate in a position wherein the central longitudinal axis X of the pressurization chamber 25 of the mold is generally vertical.

The compaction machine 101 also includes a pair of opposing vertically movable rams 41, 43 (broadly, pressurizing means) aligned with the central longitudinal axis X of the mold 21 to extend and retract along the axis. The rams 41, 43 are movable with respect to the mold 21 through respective open ends 27, 29 of the mold to pressurize particles within the pressurization chamber 25, which is defined in part by the inner surface 23 of the mold and in part by the opposing front faces of the rams 41, 43. In its initial or home position, the lower ram 41 preferably extends approximately one inch into the lower end 29 of the mold 21 and the upper ram 43 is preferably spaced a suitable distance (e.g., approximately fifteen inches) above the upper end 27 of the mold to provide sufficient clearance for loading coal particles into the mold through the open upper end of the mold. The rams 41, 43 are sized and shaped to have a relatively close clearance fit in the mold 21 to inhibit coal particles from being released from the mold by falling between the rams and the inner surface 23 of the mold.

Movement of the rams 41, 43 relative to one another is effected by actuating means comprising, in the embodiment shown in FIG. 1, lower and upper hydraulic cylinder units, indicated generally as 145 and 147, mounted on the lower and upper plates 107, 111, respectively. The hydraulic cylinder units 145, 147 are under the control of a hydraulic circuit, designated generally as 201 in FIG. 15 (broadly, control system), which supplies hydraulic fluid to the units to effect the extension and retraction of the rams 41, 43, as will be described hereafter. It will be understood that actuating means other than hydraulic cylinder units 145, 147 can be used to move the rams 41, 43. For example, pneumatic cylinder units, rodless cylinder units, or other types of linear actuators could also be used, as will be recognized by those skilled in the art.

The lower hydraulic cylinder unit 145 comprises a vertical tube 151 or cylinder mounted on the lower plate 107 of the frame so that the upper end of the tube extends above the plate. A piston 153 (FIG. 15) is reciprocable within the tube 151, and a rod 155 extends from the piston through the upper end of the tube to mount the lower ram 41 for movement up through a compaction stroke and down through a return stroke. An adapter ring 157 surrounds the upper end of the tube 151 and seats against the top of the lower plate 107. A clamp ring 159 around the upper end of the tube 151 seats against the adapter ring 157 and has an inward extending lip 160 which overlies the tube and surrounds the rod 155 to seal the end of the tube. The clamp ring 159 is fastened to the adapter ring by suitable fasteners. The tube 151 is further supported by a head plate 163 fastened to the bottom of the lower plate 107, a tail plate 165 fastened to the lower end of the tube, and eight vertical connecting rods 167 (four of which are shown in FIG. 10) extending between and fastened to the head plate and tail plate to maintain the plates in spaced relation.

An annular housing 171 extends longitudinally between the lower plate 107 and the center plate 109, enclosing the rod 155 of the lower hydraulic cylinder unit 145 and the lower end 29 of the mold 21. As coal is pressurized by the opposing rams 41, 43, water from the coal may be released from the mold 21 between the lower ram 41 and the inner surface 23 of the mold. The housing 171 recovers the water and prevents it from flowing onto other parts of the compaction machine 101. A deflector 173 encircles the clamp ring 159 used in mounting the lower cylinder unit 145 to the lower plate 107 and is attached to the clamp ring by a suitable fastener or clamp. The deflector 173 is angled down away from the clamp ring 159 toward the housing 171, so that water released from the mold 21 is directed by the deflector into an annular groove 175 formed in the lower plate adjacent the housing. The annular groove 175 communicates with a drain pipe 177 extending down through the lower plate 107 for draining the water away from the compaction machine 101.

Water from the coal may also at times be released from the mold 21 between the upper ram 43 and the inner surface 23 of the mold during pressurization and over the upper end 27 of the mold. It is contemplated that the water would then flow down the exterior of the mold 21 into an annular groove (not shown) formed in the center plate 109 adjacent the exterior of the mold. The annular groove communicates with a drain pipe (not shown) extending down through the center plate 109 for draining the water either into the housing 171 or away from the compaction machine 101.

The upper hydraulic cylinder unit 147 comprises a vertical tube 181 or cylinder mounted on the upper plate 111 of the frame so that the lower end of the tube extends below the plate. A piston 183 (FIG. 15) is reciprocable within the tube 181, and a rod 185 (FIG. 15) extends from the piston through the lower end of the tube to mount the upper ram 43 for movement down through a compaction stroke and up through a return stroke. An adapter ring (not shown, but is substantially the same as the adapter ring 157 used in mounting the lower hydraulic cylinder unit 145) surrounds the lower end of the tube 181 and seats against the bottom of the upper plate 111. A clamp ring (not shown, but is substantially the same as the clamp ring 159 used in mounting the lower hydraulic cylinder unit 145) around the lower end of the tube 181 seats against the adapter ring and has an inward extending lip (not shown) which overlies the tube and surrounds the rod 185 to seal the end of the tube. The clamp ring is fastened to the adapter ring by suitable fasteners. A flexible cover 191 attached to the bottom of the upper plate 111 encloses the rod 185 as it moves the upper ram 43 through the compaction and return strokes. The cover prevents dirt or other debris from contacting the rod 185 and entering the tube 181 of the upper hydraulic cylinder unit 147. The tube 181 is further supported by a head plate 193 fastened to the top of the upper plate 111, a tail plate 195 fastened to the upper end of the tube, and eight vertical connecting rods 197 (four of which are shown in FIG. 10) extending between and fastened to the head plate and tail plate to maintain the plates in spaced relation.

Figure 15:
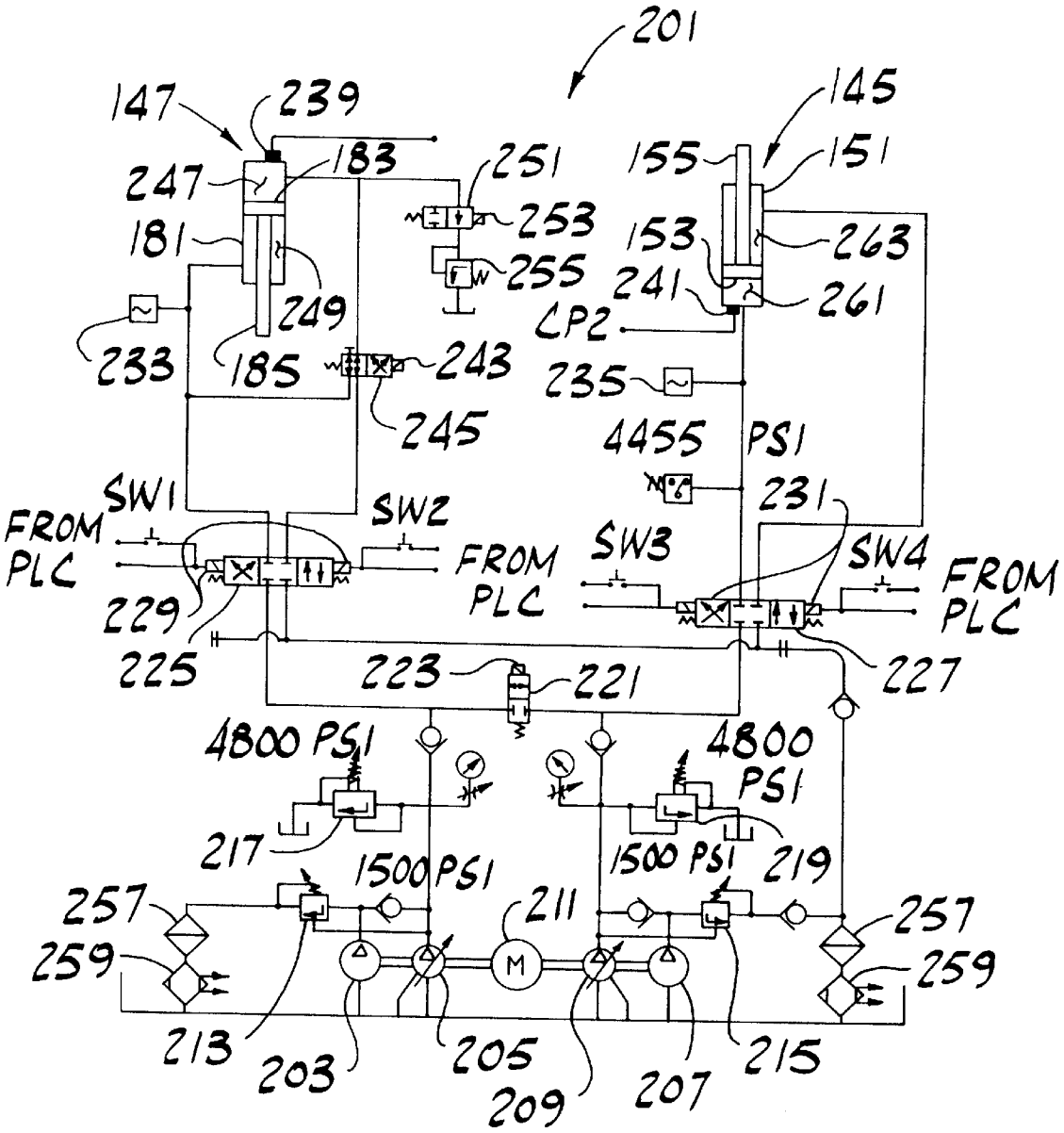
FIG. 15 is a schematic view of a hydraulic circuit for the apparatus of FIG. 1.

FIG. 15 illustrates the hydraulic circuit 201 or control system for controlling the lower and upper hydraulic cylinder units 145, 147 to move the rams 41, 43 through their compaction and return strokes. The circuit 201 comprises four fluid pumps (two low-pressure pumps designated 203 and 207, and two high-pressure pumps designated 205 and 209) driven by a single motor 211 to pump fluid, such as oil or hydraulic fluid, to the cylinder units 145, 147 via suitable fluid lines. It is contemplated that up to four motors, one for each pump, may be used without departing from the scope of this invention. A pair of pump relief valves 213, 215 communicate with the low-pressure fluid pumps 203, 207 to reroute fluid from the low-pressure fluid pumps back to a source of fluid such as tank (not shown) once the fluid pressure output of the fluid pumps reaches approximately 1,500 psi (which translates to approximately 2,000 psi pressure in each of the cylinder units 145, 147 to move the rams 41, 43, otherwise referred to as the compaction pressure). Suitable limiter valves 217, 219 also communicate with the fluid pumps 203, 205, 207, 209 to limit the fluid pressure created by the pumps to a maximum pressure of 4,800 psi.

The fluid lines leading from the pumps 203, 205, 207, 209 to the cylinder units 145, 147 are connected by a separator valve 221 which is operable by a suitable solenoid 223 to move between a closed position in which fluid from fluid pumps 203, 205 is directed only to the upper cylinder unit and fluid from fluid pumps 207, 209 is directed only to the lower cylinder unit 145, and an open position in which fluid from all four fluid pumps may be directed to either the upper or lower cylinder units. A pair of three-position valves (an upper cylinder valve 225 and a lower cylinder valve 227, respectively) controls the flow of fluid to and from the respective cylinder units 147, 145. Positioning of the valves 225, 227 is controlled by suitable solenoids 229, 231 and switches SW1, SW2, SW3, SW4 which communicate electronically with a programmable logic controller, indicated as PLC.

Pressure transducers 233, 235 communicate with respective fluid lines leading to each of the cylinder units 147, 145 to monitor the pressure in these lines. Additionally, a pressure switch 237 communicating with the fluid line leading to the lower cylinder unit 145 transmits a signal when the fluid pressure reaches a predetermined maximum compaction pressure. For example, the pressure switch 237 shown in FIG. 15 is preferably set to signal that the pressure of the fluid flowing into the lower cylinder unit 145 has reached 4,455 psi (which results in approximately 20,000 psi of compaction pressure). A position sensor 239, 241 mounted on each of the cylinder units 147, 145 senses the position of each piston 183, 153 (and hence the corresponding position of each ram 43, 41) and sends a signal to the PLC via a suitable communication line.

A junction valve 243 communicating with the fluid line leading from the upper cylinder unit 147 is operable by a suitable solenoid 245 to move between a first position in which fluid may flow from the pumps 203, 205, 207, 209 into a rear (piston end) chamber 247 of the tube 181 or out of the tube for return to the tank, and a second position in which fluid flowing out of the rear chamber of the tube is directed to flow into a front (rod end) chamber 249 of the tube. Additionally, a return valve 251 also communicates with the upper cylinder unit 147 and is operable by a solenoid 253 to move between an open position and a closed position, respectively, in which fluid may or may not return to the tank. When the return valve 251 is open, fluid returning to the tank is directed through a relief valve 255. The relief valve 255 is adjustable for restricting the flow of fluid out of the rear chamber 247 of the tube 181 for return to the tank. The relief valve is preferably set to provide a predetermined restricted flow rate. However, the relief valve may be adjusted during operation of the machine without departing from the scope of this invention. In this manner, the relief valve 255 restricts the rate at which the upper ram 43 may be retracted so as to maintain a back pressure on the coal log as it is ejected from the mold 21. Conventional filters 257 and coolers 259 communicate with the fluid lines leading to the tank for filtering and cooling the fluid returning to the tank.

The operation of the apparatus of the present invention will now be described. Initially, the rams 41, 43 are in their retracted positions, the upper ram 43 being positioned well above the upper end 27 of the mold 21 and the lower ram 41 being positioned slightly into the lower end 29 of the mold. Coal particles, well mixed with a binder additive, are loaded into the pressurization chamber 25, either manually or by an automatic loader (not shown) where the particles are retained in place by the lower ram 41 and the inner surface 23 of the mold 21. The machine 101 is then activated either manually, by pressing a start button (not shown), or automatically upon receiving a signal that the loading process is complete. The lower cylinder valve 227 is closed to prevent the flow of fluid to the lower cylinder unit 145. The upper cylinder valve 225 is moved to the far left as viewed in FIG. 15 (i.e. so that the parallel arrows are selected), the junction valve 245 is moved to the left (i.e. so that the crossed arrows are selected) and the return valve 251 is closed to prevent fluid from returning to the tank. Positioning the valves in this manner allows fluid to flow into the rear chamber 247 of the tube 181 of the upper cylinder unit 147 to move the upper ram 43 down toward the open upper end 27 of the mold 21. To increase the rate of extension of the upper ram 43, the separator valve 221 is opened to direct fluid from all four fluid pumps 203, 205, 207, 209 to flow into the rear chamber 247 of the tube 181 of the upper cylinder unit 147.

When the position sensor 239 mounted on the upper cylinder unit 147 senses that the upper ram 43 has extended a predetermined distance into the upper end 27 of the mold 21, such as, for example, 1.5 inches, the separator valve 221 is closed, and the lower cylinder valve 227 is moved to the far left as viewed in FIG. 15 (i.e. so that the parallel arrows are selected) to allow fluid to flow into a rear chamber 261 of the tube 151 of the lower cylinder unit 145 to move the lower ram 41 further up into the lower end 29 of the mold 21.

With the return valve 251 still closed, the upper cylinder valve 225 is moved to the far right (i.e. so that the crossed arrows are selected) and the junction valve 245 is moved to the far right to allow fluid to flow directly to the rear chamber 247 of the tube 181 of the upper cylinder unit 147 at a rate substantially equal to the rate at which fluid flows into the rear chamber 261 of the tube 151 of the lower cylinder unit 145. The upper and lower rams 43, 41 thus move toward one another to apply substantially equal and opposite compaction pressures to the coal particles within the pressurization chamber 25 of the mold 21.

Based on signals received from the position sensors 239, 241 mounted on each of the cylinder units 147, 145, the fluid pressure created by the pumps gradually increases as the rams 41, 43 move closer together, i.e., as the particles within the pressurization chamber are increasingly compacted under the substantially equal pressures exerted by the rams. When the fluid output pressure of the pumps 203, 205, 207, 209 reaches approximately 1,500 psi, the pump relief valves 213, 215 are activated to reroute fluid from the low-pressure pumps 203, 207 back to the source of fluid (e.g. the tank). The high-pressure pumps 205, 209 supply the remaining fluid pressure necessary to complete compaction of the coal particles in the pressurization chamber 25. Depending on the particular physical properties of the coal particles being compacted, such as density and moisture content, approximately eighty percent of the compaction is complete when the fluid pressure reaches 1,500 psi. The high-pressure fluid pumps 205, 209 continue to increase the fluid pressure until a maximum compaction pressure is achieved, which may be determined by sensing the position of one or more of the rams 41, 43 (e.g., by sensing the position of the upper ram 43 by position sensor 239), or by monitoring the pressure of the fluid flowing to the lower cylinder unit 145 by means of the pressure transducer 235 and pressure switch 237. When a fluid pressure corresponding to the maximum compaction pressure is measured by the pressure transducer 235 (e.g., a fluid pressure of 4,455 psi corresponding to the preferred maximum compaction pressure of 20,000 psi), the pressure switch 237 signals the PLC to effect a closing of the upper and lower cylinder valves 225, 227, thereby cutting off further flow of fluid to the cylinder units 145, 147 to prevent an increase in compacting pressure. The rams 41, 43 are then held in position to maintain the maximum compaction pressure for a predetermined holding period (e.g. a few seconds) to assure sufficient compaction of the coal particles to form the coal log.

After the predetermined compaction holding period has elapsed, an ejection sequence for ejecting the coal log from the mold 21 is initiated. The return valve 251 communicating with the tube 181 of the upper cylinder unit 147 is opened to allow fluid to flow from the upper cylinder unit through the relief valve for restricted return flow to the tank at the predetermined rate. The junction valve 245 is moved to the left to direct some of the fluid released from the rear chamber 247 of the tube 181 to flow into the front chamber 249 of this tube to retract the upper ram 43 up out of the mold 21. As fluid leaves the rear chamber 247, the compaction pressure applied by the upper ram 43 decreases accordingly. The compaction pressure applied by the lower ram 41 is correspondingly reduced since the upper ram 43 no longer counterbalances the lower ram. By restricting the flow of fluid from the rear chamber 247, pressure contact between the upper ram 43 and the coal log is maintained such that a reduced amount of compaction pressure, otherwise referred to as back pressure, is applied by the upper ram to the coal log as it is ejected from the mold 21. As an example, the preferred back pressure is approximately eight percent of the maximum compaction pressure (e.g., 1600 psi for a maximum compaction pressure of 20,000 psi), but this may vary depending on the material being compacted.

As the coal log is pushed upward out of the upper end 27 of the mold 21, the position sensor 239 mounted on the upper cylinder unit 147 senses the position of the upper ram 43 relative to the mold. When the upper ram 43 (and hence the leading edge of the coal log) reaches the top of the upper end 29 of the mold 21, the return valve 251 is closed and the junction valve 245 is moved to the right so that fluid flowing from the rear chamber 247 of the tube 181 of the upper cylinder unit 147 passes through the junction valve as for return to the tank. The upper cylinder valve 225 is moved to the far left to allow fluid to flow into the front chamber 249 of the tube 181 of the upper cylinder unit 147 to increase the rate at which the upper ram 43 is retracted. The increased rate of retraction moves the upper ram 43 up out of contact with the coal log, thereby relieving the back pressure applied to the coal log. The lower cylinder valve 227 is moved to the far left such that the lower ram 41 continues to push the coal log out of the mold 21 without substantial resistance.

After the coal log is fully ejected from the mold 21, the coal log is automatically pushed away from the machine 101 and loaded onto a conveyor (not shown) by the machine. The lower cylinder valve 227 is then moved to allow fluid to flow into a front chamber 263 of the tube 151 of the lower cylinder unit 145 and to flow from the rear chamber 261 for return to the tank, thereby retracting the lower ram 41 back to its initial position. Since the compaction process may result in heating of the oil or hydraulic fluid, the fluid passes through the filters 257 and water coolers 259 before returning to the tank.

It will be observed from the foregoing that the mold, apparatus and method of the present invention represent an improvement over conventional apparatus and methods. As a result of the flared (rounded or tapered) end surface 31 of the mold 21, the aggregate product formed within the mold is allowed to expand gradually as it is ejected from the mold, thereby reducing the risk of cracking or splitting. This risk is reduced further by applying a back pressure to the aggregate product as it is ejected from the mold.

Using a pair of opposing rams 41, 43 in the apparatus of the present invention for pressurizing the coal particles results in a more evenly distributed stress concentration and density along the length of the coal log. By using a mold 21 having a flared end surface 31 and applying back pressure during ejection from the mold to assure sufficient compaction and to reduce the risk of cracking or splitting, a coal log of increased strength and quality is produced which is capable of withstanding the rigors of transport, and in particular the wear and tear involved in transporting the coal logs through a hydraulic coal log pipeline.

Additionally, because the coal logs produced by the mold, apparatus and method of the present invention are more compact and are subject to less cracking, they are substantially less brittle than those produced by conventional means, and the time it takes to compact and eject the logs is significantly reduced, resulting in improved efficiency and substantial cost savings over conventional means. For example, manufacture by conventional means takes minutes or even hours to produce a coal log, primarily because the log is very brittle and must be ejected from the mold very slowly to reduce the risk of the log cracking or splitting. The increased quality of the coal logs produced by the mold, apparatus and method of the present invention allows production time to be reduced to about 18–20 seconds per log. An approximate breakdown of the production time is 6 seconds to load the coal particles and binder into the mold, 1.5 seconds to move the upper ram down into the pressurization chamber, 3.5–5.0 seconds to compact the coal particles to form the coal log, 2.5 seconds to push the coal log to the upper end of the mold while applying back pressure, 2.2 seconds to complete ejection of the coal log from the mold after the back pressure is removed, and 3.0 seconds to retract the rams back to their fully retracted position.

In view of the above, it will be seen that the several objects of the invention are achieved and other advantageous results attained.

As various changes could be made in the above constructions without departing from the scope of the invention, it is intended that all matter contained in the above description or shown in the accompanying drawings shall be interpreted as illustrative and not in a limiting sense.

What is claimed is:

1. A mold for use in making an aggregate product from particulate material, said mold having open ends, an inner surface between said open ends defining, in part, a pressurization chamber for receiving said particulate material so that it may be pressurized to form the aggregate product, said chamber having a central longitudinal axis, said inner surface of the mold being substantially parallel to the central longitudinal axis, one of the open ends of the mold having a flared inner peripheral end surface flaring outwardly away from the pressurization chamber and the central longitudinal axis thereof for allowing expansion of said aggregate product as it is pushed out of said one end of the mold past said flared end surface.

2. A mold as set forth in claim 1 wherein said flared end surface is rounded and curves outwardly away from the pressurization chamber and the central longitudinal axis.

3. A mold as set forth in claim 2 wherein said inner surface of the mold is generally cylindric, the ratio of the radius of curvature of said rounded end surface to the radius of the inner surface of the mold being about 0.13.

4. A mold as set forth in claim 1 wherein said flared end surface is tapered and slopes outwardly away from said inner surface defining the pressurization chamber and away from the central longitudinal axis of the pressurization chamber.

5. Apparatus for making a coal log from coal particles, said apparatus comprising:

a frame;

a mold supported by the frame, said mold having first and second open ends, an inner surface between said open ends defining, in part, a pressurization chamber for receiving said particulate material so that it may be pressurized to form the coal log, said chamber having a central longitudinal axis, said inner surface of the mold being substantially parallel to the central longitudinal axis, said first end of the mold having a flared inner peripheral end surface flaring outwardly away from the pressurization chamber and the central longitudinal axis thereof for allowing expansion of the coal log as it is pushed out of the first end of the mold past said flared end surface; and pressurizing means supported by the frame operable to pressurize the coal particles within the pressurization chamber to form said coal log and to push the coal log out of the first end of the mold past said flared end surface.

6. Apparatus as set forth in claim 5 wherein said flared end surface is rounded and curves outward away from the pressurization chamber and the central longitudinal axis.

7. Apparatus as set forth in claim 6 wherein said inner surface of the mold is generally cylindric, the ratio of the radius of curvature of said rounded end surface with respect to the radius of the inner surface of the mold being about 0.13.

8. Apparatus as set forth in claim 5 wherein said flared end surface is tapered and slopes outwardly away from said inner surface defining the pressurization chamber and away from the central longitudinal axis of the pressurization chamber.

9. Apparatus as set forth in claim 6 wherein said pressurizing means comprises first and second opposing rams mounted on the frame generally adjacent said open ends of the mold, the first ram being disposed generally adjacent the first open end of the mold and the second ram being disposed generally adjacent the second open end of the mold; and actuating means for moving the rams toward and away from one another along the central longitudinal axis of the pressurization chamber.

10. Apparatus as set forth in claim 9 wherein said pressurizing means further comprises a control system for controlling said actuating means to move the rams to apply opposing compacting forces to the coal particles in the pressurization chamber of the mold to form a coal log, and to move the rams after the coal log is formed to eject the coal log from the mold through the first open end of the mold past said flared end surface.

11. Apparatus as set forth in claim 10 wherein said control system is operable for controlling the actuating means to move the second ram toward the first open end of the mold after the coal log is formed to push the coal log from the mold, said control system further being operable for controlling said actuating means to maintain said first ram in pressure contact with the coal log as it is pushed from the mold thereby to apply a back pressure to the coal log as it is pushed from the mold.

12. Apparatus as set forth in claim 11 wherein said control system comprises a sensor for sensing the position of the first ram and for generating a signal when the first ram moves out of the mold past the first open end of the mold, said actuating means being responsive to said signal to move the first ram out of pressure contact with the coal log.

13. Apparatus as set forth in claim 11 wherein said first ram is movable from a retracted position spaced from the first end of the mold to allow loading of particulate material into the mold through the first end of the mold, through a pressure stroke during which it enters the mold through the first open end and applies a compacting force to the coal particles in the pressurization chamber, and through a return stroke back to its said retracted position.

14. Apparatus as set forth in claim 13 wherein said second ram is movable by said actuating means to apply a compacting force to the coal particles in the pressurization chamber to form the coal log, and then to push the coal log toward said first open end of the mold.

15. Apparatus as set forth in claim 9 wherein said frame comprises an upper plate mounting the first ram, constituting an upper ram, a lower plate spaced below the upper plate mounting the second ram, constituting a lower ram, and an intermediate plate disposed between the upper and lower plates mounting the mold with the central longitudinal axis of the pressurization chamber generally vertical and with the first open end of the mold facing upward toward the upper ram, the upper ram being receivable in the upward facing first open end of the mold and the lower ram being receivable in the opposite downward facing second open end of the mold; and a housing for recovering liquid released from the second open end of the mold during formation of the coal log, said housing extending longitudinally between the lower plate and the intermediate plate and having an open upper end generally in alignment with the second open end of the mold.

16. Apparatus as set forth in claim 15 further comprising a drain pipe mounted on the lower plate for draining liquid recovered by the housing away from the apparatus.

17. Apparatus as set forth in claim 16 further comprising an annular groove in the lower plate in fluid communication with the drain pipe for directing liquid recovered by the housing into the drain pipe, and an annular deflector adjacent the lower plate within the housing sloping down toward the groove to direct liquid released from the mold into the groove.

18. Apparatus as set forth in claim 17 wherein said drain pipe is a first drain pipe and said annular groove is a first annular groove, said apparatus further comprising a second a drain pipe mounted on the center plate for draining liquid released from the upward facing first open end of the mold away from the apparatus, and a second annular groove in the center plate in fluid communication with the drain pipe for directing fluid into the drain pipe.

19. Apparatus for making a coal log from coal particles, said apparatus comprising:

a frame;

a mold supported by the frame, said mold having first and second open ends and an inner surface defining, in part, a pressurization chamber for receiving coal particles so that they may be pressurized to form said coal log; and pressurizing means supported by the frame, said pressurizing means being operable to pressurize the coal particles within the pressurization chamber to form the coal log and further being operable to push the coal log out of the mold while maintaining a back pressure on the coal log.

20. Apparatus as set forth in claim 19 wherein said pressurizing means comprises first and second opposing rams mounted on the frame generally adjacent said open ends of the mold, the first ram being disposed generally adjacent the first open end of the mold and the second ram being disposed generally adjacent the second open end of the mold; and actuating means for moving the rams toward and away from one another along the central longitudinal axis of the pressurization chamber.

21. Apparatus as set forth in claim 20 wherein said pressurizing means further comprises a control system for controlling said actuating means to move the rams to apply opposing compacting forces to the coal particles in the pressurization chamber of the mold to form a coal log, and to move the rams after the coal log is formed to eject the coal log from the mold through the first open end of the mold.

22. Apparatus as set forth in claim 21 wherein said control system is operable for controlling the actuating means to move the second ram toward the first open end of the mold after the coal log is formed to push the coal log from the mold, said control system further being operable for controlling said actuating means to maintain said first ram in pressure contact with the coal log as it is pushed from the mold thereby to apply a back pressure to the coal log as it is pushed from the mold.

23. A method of making coal logs from coal particles, said method comprising:

loading the coal particles into a mold having an open end and an inner surface defining, in part, a pressurization chamber, said open end having a flared inner peripheral end surface;

pressurizing said coal particles within the pressurization chamber such that the coal particles aggregate to form the coal log; and pushing the coal log out of the mold past the flared end surface so that the coal log expands as it passes the flared end surface.

24. A method as set forth in claim 23 wherein said flared end surface is rounded and curves outwardly away from the pressurization chamber and the central longitudinal axis.

25. A method as set forth in claim 23 wherein said flared end surface is tapered and slopes outwardly away from said inner surface defining the pressurization chamber and away from the central longitudinal axis of the pressurization chamber.

26. A method as set forth in claim 23 further comprising the step of maintaining back pressure on the coal log as the coal log is pushed out of the mold.

27. A method as set forth in claim 23 wherein said step of pressurizing the coal particles comprises applying a pair of opposing compacting forces to the coal particles within the pressurization chamber to compact the coal particles into a coal log, and wherein the step of pushing the coal log out of the mold comprises reducing one of said compacting forces whereby the other of said compacting forces pushes the coal log out of said mold past the flared end surface while the reduced compacting force applies a back pressure to the coal log as it is pushed out of the mold.

28. A method as set forth in claim 26 further comprising the step of removing the back pressure applied to the coal log after a leading edge of the coal log reaches the end of the mold.

29. A method of making coal logs from coal particles said method comprising:

loading the coal particles into a mold having first and second open ends and an inner surface defining, in part, a pressurization chamber;

operating opposing first and second rams to apply compacting pressures to the coal particles in the pressurization chamber to form said coal log; and after the coal log is formed, reducing the compacting pressure applied by the first ram and continuing to operate the second ram to apply a force sufficient to push the coal log out of the mold while said first ram maintains a back pressure on the coal log as it is pushed out of the mold.

* * * * *